United States Patent [19]

Hastings

[11] Patent Number: 4,722,036

[45] Date of Patent: Jan. 26, 1988

[54] FLASHLIGHT

[75] Inventor: Kenneth T. Hastings, St. Albans Town, Vt.

[73] Assignee: Eveready Battery Company, St. Louis, Mo.

[21] Appl. No.: 13,810

[22] Filed: Feb. 12, 1987

[51] Int. Cl.[4] ..... F21L 7/00

[52] U.S. Cl. ..... 362/203; 362/204

[58] Field of Search ..... 362/203, 204, 205, 206

[56] References Cited

U.S. PATENT DOCUMENTS 3,798,440 3/1974 Brindley ..... 240/10.66
3,963,886 6/1976 Ting ..... 200/60
4,176,263 11/1979 Rousseau ..... 200/60
4,458,299 7/1984 Stephens et al. ..... 362/158
4,484,253 11/1984 Roberts ..... 362/206

*Primary Examiner*—Carroll B. Dority, Jr.
*Attorney, Agent, or Firm*—Virgil B. Hill

[57] ABSTRACT

A flashlight employing a battery casing, switching means and a lens and reflector unit, said battery casing adapted to accommodate one or more cells and having a single conductive coil spring member for providing an electrical path from a terminal of a cell disposed near the bottom of the casing to the open end area of the casing where the spring can electrically contact a terminal on the switch means or a terminal on the lamp of the flashlight.

11 Claims, 7 Drawing Figures

FIG. 2
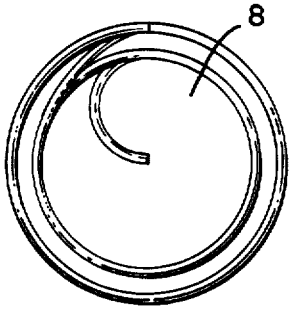
FIG. 1
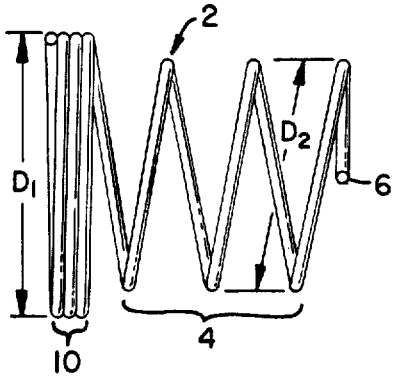
FIG. 3
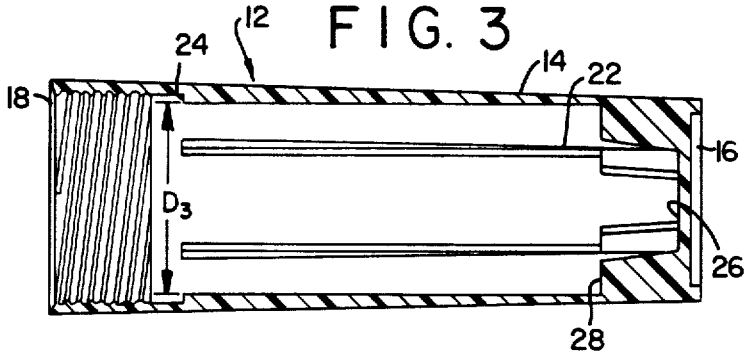
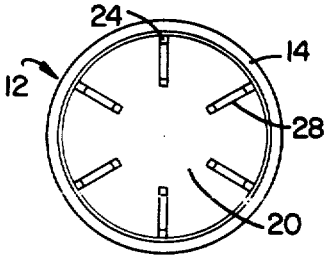
FIG. 4

FLASHLIGHT

FIELD OF THE INVENTION

This invention relates to a flashlight employing a battery casing having a closed end and an open end and wherein a one piece novel conductive coil spring is used for providing an electrical path from a terminal of a battery disposed at the closed end of the casing to an area near the open end of the casing.

BACKGROUND OF THE INVENTION

Various tubular flashlights have been developed which use a tubular battery casing for accommodating one or more cylindrical batteries. The batteries generally have one polarity terminal at one end and a second polarity terminal at the other end so that when the battery is fed into the battery casing, one polarity is disposed near the closed end of the casing. Generally, a conductive strip near the open end of the casing extends within the casing to contact a conductive compressive spring disposed at the closed end of the casing so as to provide an electrical path from the battery polarity terminal at the closed end of the casing to the area near the open end of the casing. The end of the conductive strip near the open end of the casing is generally adapted to make electrical contact to the switch for the flashlight or to one of the terminals on the flashlight bulb. As discussed above, the means for providing this electrical path for the battery polarity terminal near the bottom of the casing to the open end of the casing generally requires three separate components consisting of a conductive compressive spring, a conductive strip, and a conductive ring:

U.S. Pat. No. 3,798,440 to Robert Brindley illustrates a flashlight that employs these three separate components. Specifically, the flashlight discloses the use of a compressive spring disposed in the bottom of a closed end battery casing which makes electrical contact with one end of a conductive L-shaped conductive strip. The L-shaped conductive strip is disposed against the internal wall of the battery casing and its opposite end makes electrical contact with a conductive contact ring disposed within the open end vicinity of the battery casing. The use of these three separate components for providing the electrical path from the bottom of the casing to the open end of the casing requires that good electrical contacts be made between one end of the conductive strip to the compressive spring and between the opposite end of the conductive strip to the conductive ring. In addition, space has to be provided at the closed end of the casing to accommodate the compressive spring thereby requiring the overall length of the flashlight to be longer than what would be required if the compressive spring was not needed.

It is an object of the present invention to provide a flashlight with means which are highly reliable and cost effective for providing an electrical path from the bottom end of a battery casing to an area near the open end of said casing.

It is another object of the present invention to replace the three component assembly consisting of a conductive strip, a compressive spring and a conductive ring that is normally used to provide an electrical path from the bottom end of a battery casing to its open end, with a single conductive coil spring member.

It is another object of the present invention to use a novel conductive spring for use in flashlights to provide an electrical path from the bottom of the battery casing where the end of the spring is adapted to contact one polarity terminal of a battery to an area near the open end of the battery casing where the spring is adapted to electrically contact the switch of the flashlight or one terminal of the circuit coupled to the bulb.

The forgoing and additional objects will become more fully apparent from the following description.

SUMMARY OF THE INVENTION

The invention relates to a flashlight comprising a lens and reflective unit and a lamp holder adapted to accommodate a lamp having a first terminal member and a second terminal member; a battery casing having a closed end, an open end, and a cavity defined within said casing for accommodating battery means having a first polarity terminal and a second polarity terminal; switch means operable between a first position where said first polarity terminal is electrically connected to said first terminal member of said lamp and said second polarity terminal is electrically connected to said second terminal member of said lamp, and a second position for interrupting the electrical continuity between one of the terminal members of the lamp and one of the polarity terminals of the battery means; a conductive coil spring defining an internal cavity sufficient to accommodate said battery means, a first end of said coil spring projected within said cavity of said coil spring to at least partially block said cavity and being adapted to contact one polarity terminal of said battery means and a second end of said coil spring which has at least a portion formed to provide an outer inscribed circular diameter that is larger than the external inscribed circular diameter at said first end of said coil spring and larger than the internal inscribed circular diameter of the cross-sectional area near the open-end of said battery casing, and said coil spring being adapted to provide an electrical path to said switch means or to a terminal of said lamp; said coil spring disposed within said battery casing such that said first end is positioned closer to said closed end and said second end is seated at a portion of said battery casing near the open end where said internal inscribed circular diameter of said battery casing is smaller than the external inscribed circular diameter of said second end of said coil spring, and said coil spring operable such that when said battery means are inserted within said casing one of its polarity terminals contacts said first end of said coil spring and forces said end further into said casing thereby maintaining good physical and electrical contact between said first end and said polarity terminal while said second end of said coil spring remains secure at the portion of said casing nearer its open end thereby providing an electrical path from said polarity terminal near the closed end of the casing to an area near the opening end of said casing where it is adapted to electrically contact said switch means or a terminal of said lamp.

As used herein, an internal inscribed circular diameter of a cross-sectional area in the cavity formed in the battery casing means a circular diameter formed by the extremities of any protruding members within said cavity. Consequently, if longitudinal ribs are disposed on the internal wall of the battery casing then the extremities of the ribs will be used to inscribe an internal circular diameter defining the cross-sectional area of the cavity. Likewise, an external circular inscribed diameter of the upper or lower end of the coil spring means a circular diameter formed by the extremities of the spring at said upper or lower ends. Consequently, with the outer circular inscribed diameter of the coil spring larger than the internal inscribed circular diameter at the upper end of the casing, the upper end of the coil spring will be trapped or seated within the casing at its upper end while the opposite end of the coil spring can be projected into the casing upon the insertion of a battery.

With the elimination of the compressive spring normally used in flashlights, the flashlight of the present invention could be made shorter to provide a more compact unit, if desired. In addition, by the elimination of the contact points required in the conductive strip, compressive spring and contact ring assembly, the single unit of this invention will improve the flashlight's overall reliability by eliminating two electrical contact points at which a high resistance contact may develop.

The battery casing could assume any external configuration while the internal cavity could be defined by inwardly projecting ribs. In one embodiment, the ribs may project radially inward only on the upper portion of the battery casing nearer the open end. Another embodiment could employ a flange at the upper end of the battery casing to trap and secure the upper end of the coil spring. In all of the embodiments one essential feature that is required is that the internal inscribed circular diameter of the cross-sectional area at the end closer the open end of the battery casing be smaller than the external inscribed circular diameter formed in the upper part of the conductive coil spring.

Battery means shall mean one or more cells with the specific number and size being governed by the size and shape of the battery casing. The more conventional size battery casing usually accommodates two D-size or C-size cells.

DRAWINGS

Further objects, features and advantages of the invention will become apparent upon consideration of the following detailed description of the preferred embodiment when considered in conjunction with the following drawings, in which:

FIG. 1 is a side elevational view of a conductive coil spring for use in this invention.

FIG. 2 is a front view of the conductive coil spring shown in FIG. 1.

FIG. 3 is a side elevational view, in cross-section, of a battery casing for use in this invention.

FIG. 4 is a front view of the battery casing shown in FIG. 3.

Figure 5:
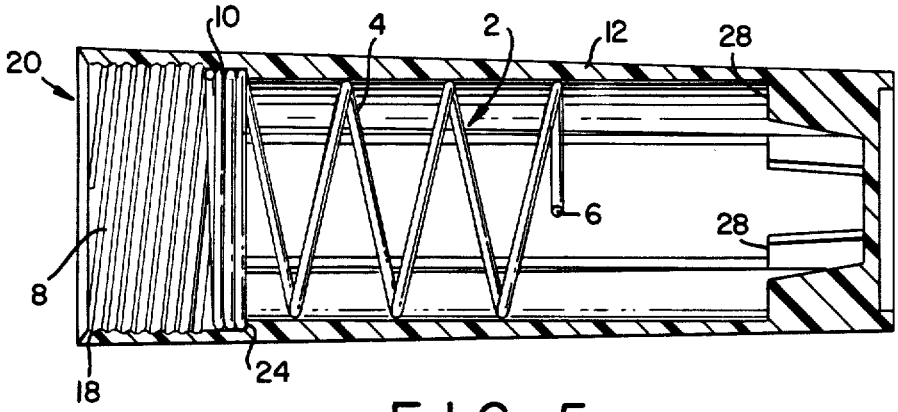
FIG. 5 is a side elevational view, in cross section; of the conductive coil spring shown in FIG. 1 assembled in the battery casing shown in FIG. 3.

Referring to FIGS. 1 and 2, there is shown a conductive coil spring 2 comprising a lower part 4 terminating in an end portion 6 projected radially inward so as to block part of the internal cavity 8 defined by coil spring 2. The upper part 10 of coil spring 2 is formed to provide an outer inscribed circular diameter $D_1$ which is larger than the outer inscribed circular diameter $D_2$ at lower part 4 of coil spring 2.

FIGS. 3 and 4 show a battery casing 12 comprising a cylindrical member 14 having a closed end 16 and an open end 18. Cylindrical member 14 defines an internal cavity 20 having several spaced apart longitudinal ribs 22 extending within casing 14. The upper ends 24 of ribs 22 provide a flange-like surface having an internal inscribed circular diameter $D_3$ that is (a) smaller than the outer inscribed circular diameter $D_1$ of coil spring 2 of FIGS. 1 and 2 and (b) larger than the outer inscribed circular diameter $D_2$ of coil spring 2. Projected from the bottom surface 26 are support members 28 which in some applications may be used to prevent batteries from being inserted too far into casing 12 which could possibly result in breaking the electrical contact with the top terminal of the battery to either the switch means or to terminal on the lamp.

FIG. 5 shows coil spring 2 assembled in casing 12 so that the upper portion 10 of coil spring 2 is seated upon ridge 24 and secured within casing 12 while the lower portion 4 extends into casing 12. The cavity 8 formed in coil spring 2 is sufficient to accommodate one or more cells, such as D-size cells. As evident from FIG. 5, as a cell is fed into casing 12, one of its polarity terminals would contact end 6 and force the lower portion 4 of coil spring 2 further into casing 12 where the battery in some applications would come to rest against support members 28. End 6 would be in physical and electrical contact with the terminal of the battery and coil spring 2 would provide an electrical path from said terminal of the battery near the closed end of the casing 12 to an area near the open end 18 of casing 12. If desired, a tubular member could be disposed within the cavity of the coil spring to prevent the coil spring from contacting and possibly damaging the outer circumferential label of the battery.

Figure 6:
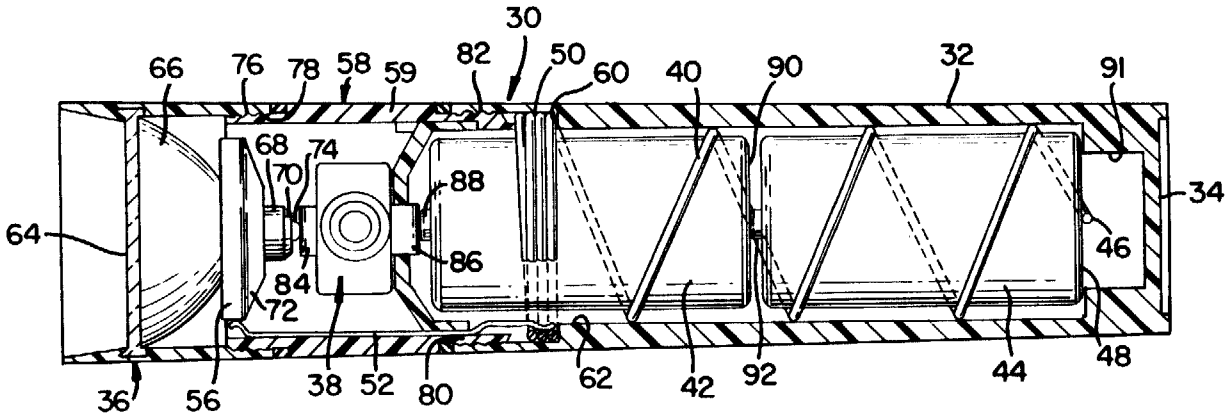
FIG. 6 is a side elevational view, in cross-section, of an assembled flashlight using the conductive coil spring shown in FIG. 1.

FIG. 6 shows an assembled flashlight 30 having a battery casing 32 closed at one end 34, a lens and reflective unit 36 and switch means 38 of the type disclosed in U.S. Pat. No. 3,798,440, said disclosure in U.S. Pat. No. 3,798,440 incorporated herein by reference. Coil spring 40 of the type shown in FIG. 1 is shown expanded into casing 32 by the insertion of batteries 42 and 44. End 46 of coil spring 40 makes physical and electrical contact with terminal 48 while upper end 50 of coil spring 40 makes physical and electrical contact to one end of conductive strip 52 with the other end of conductive strip 52 making electrical contact to contact shell 56. Conductive strip 52 is disposed on the internal surface of switch module 58 that contains switch means 38 so that when switch module 58 is secured onto the open end of casing 32, conductive strip 52 will project within casing 32 and make electrical contact with the upper portion 50 of coil spring 40. As shown in FIG. 6, upper portion 50 of coil spring 40 seats on and is secured on flange 60 of ribs 62. Thus the single unit coil spring 40 provides a good electrical path from terminal 48 of battery 44 to conductive strip 52 which in turn is electrically connected to contact shell 56.

Lens and reflector unit 36 comprises lens 64, reflector 66, contact shell 56, bulb holder 68 and lamp 70. Reflector 66 is of the conventional type comprising material, such as plastic, for instance, polystyrene, and having substantially corresponding concavo-convex sides, the concave side of which is provided with a metallic reflectory coating such as aluminum applied by conventional vacuum-metallizing techniques or the like, and a central apertured cylindrical neck. The contact shell 56, composed of an electrically conductive material, is preferably of frusto-conical shape with a tubular socket axially formed therein. The tubular socket of contact shell 56, although not shown, is secured within the apertured neck of reflector 66 and has a flanged end which interlocks with an annular flange which is integrally molded to the opening of the apertured neck. The frusto-conical portion of contact shell 56 forms an annular shaped skirt 72 which projects radially outwardly from and out of contact with reflector 66. The tubular socket also provides a seat against which a flanged neck of lamp 70 is positioned. Said lamp 70 being of the conventional type having a cylindrical base including a button type terminal 74.

Bulb holder 68 is tubular shaped and is composed of a resilient material, preferably a molded plastic, such as polyethylene. Bulb holder 68 is securely mounted within the tubular socket by conventional means and has a socket within which is disposed the base of lamp 70. For example, the forward end portion of the tubular socket of bulb holder 68 may be formed with a channel or groove which engages with a corresponding peripheral bead portion formed on the inside surface of a tubular socket of contact shell 56. The channel or groove, and corresponding bead can be of such size and arranged so as to permit the forward end of the bulb holder 68 to be securely snapped into place by merely pushing holder 68 through the rear open end of the tubular socket where it will be securely retained. To remove holder 68 to replace lamp 70, the holder is simply pulled outwardly from socket to detach its forward end. Once the lamp is replaced, it is simply pushed back into the socket. The assembled unit containing reflector 66, contact shell 56, bulb holder 68, and lamp 70 is held securely within the lens and lens ring assembly by friction fit.

The lens and reflective unit 36, preferably molded of a suitable material, such as plastic, for example ABS or polyolefin, has a threaded segment 76 for engaging with threaded segment 78 of switching module 58.

Switching module 58 comprises a tubular modular casing 59 having threaded segment 78 adapted to engage with threaded segment 76 of lens and reflector unit 36, and at the opposite end it has threaded segment 80 adapted to engage with threaded segment 82 of battery casing 32.

As shown in FIG. 6, terminal 74 of lamp 70 is in electrical contact with terminal 84 of switch means 38 while the opposite terminal 86 of switch means 38 is in electrical contact with terminal 88 of battery 42. With batteries 42 and 44 assembled in casing 32 and switch module 58 threadably secured at one end to battery casing 32 and at the opposite end to lens and reflector unit 36, the flashlight is fully assembled and ready for operation.

As shown in FIG. 6, one terminal 48 of battery 44 is in electrical contact with end 46 of coil spring 40 which in turn is in electrical contact with contact shell 56 via conductive strip 52, said contact shell 56 being in electrical contact with one terminal (not shown) of lamp 70. The opposite terminal 74 of lamp 70 is in electrical contact with terminal 84 on switch means 38 while the opposite terminal 86 of switch means 38 is in electrical contact with terminal 88 of battery 42. Battery 42 is in series with battery 44 such that terminal 90 is in electrical contact with terminal 92 of battery 44. Thus, the activation of switch means 38 will internally couple or uncouple conductive terminals 84 and 86 which electrically connects or disconnects, respectively, terminal 74 of lamp 70 to terminal 88 of battery 42 which will effectively complete or interrupt the electrical circuit of the flashlight. Although a button switch is shown in the drawing, any conventional type of switch could be used in this invention. If desired, the support members 91 could be eliminated so that the flashlight could be made into a more compact unit. To insure a water-tight seal at the threaded engagement areas between one end of switch module 58 and lens and reflective unit 36, and between the opposite end of switch module 58 and the battery casing 32, gaskets or o-rings could be employed. The gaskets or o-rings could be made of rubber, a low density polyolefin, or the like, as long as such gaskets are water resistant so as to promote a water-tight seal for the threaded areas.

Figure 7:
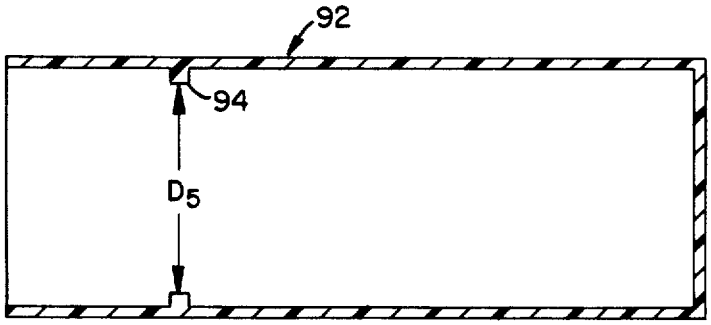
FIG. 7 is a side elevational view, in cross-section, of another embodiment of a battery casing for use in this invention.

In FIG. 7 another embodiment of a casing 92 is shown in which an internal circumferential flange 94 is used to provide an internal inscribed circular diameter $D_5$ near the open end of casing 92 that is smaller than the external inscribed circular diameter $D_1$ of coil spring 2. In all embodiments of the invention the closed end of the battery casing could form an integral part of the casing or could be a cap or the like secured to the end of the casing. In addition to the ribs shown in FIGS. 3 and 4 for providing a flange onto which the upper portion of the coil spring could seat and be secured, additional ribs could be used on the interior of the battery casing to more accurately center the batteries within the casing.

A flashlight constructed in the manner described above would be admirably suited for use in all applications requiring a sturdy, durable, lightweight flashlight. Although this invention has been described with reference to many specific details thereof, it is apparent that the invention is not limited to such details.

What is claimed:

1. A flashlight comprising a lens and reflective unit and a lamp holder adapted to accommodate a lamp having a first terminal member and a second terminal member; a battery casing having a closed end, an open end, and a cavity defined within said casing for accommodating battery means having a first polarity terminal and a second polarity terminal; switch means operable between a first position where said first polarity terminal is electrically connected to said first terminal member of said lamp and said second polarity terminal is electrically connected to said second terminal member of said lamp, and a second position for interrupting the electrical continuity between one of the terminal members of the lamp and one of the polarity terminals of the battery means; a conductive coil spring defining an internal cavity sufficient to accommodate said battery means, a first end of said coil spring projected within said cavity of said coil spring to at least partially block said cavity and being adapted to contact one polarity terminal of said battery means and a second end of said coil spring which has at least a portion formed to provide an external inscribed circular diameter that is larger than the external inscribed circular diameter at said first end of said coil spring and larger than said internal inscribed circular diameter of said cross-sectional area near the open-end of said battery casing, and said coil spring being adapted to provide an electrical path to said switch means or to a terminal of said lamp, said coil spring disposed within said battery casing such that said first end is positioned closer to said closed end and said second end is seated at a portion of said battery casing near the open end where said internal inscribed circular diameter of said battery casing is smaller than the external inscribed circular diameter of said second end of said coil spring, and said coil spring operable such that when said battery means are inserted within said casing one of its polarity terminals contacts said first end of said coil spring and forces said end further into said casing thereby maintaining good physical and electrical contact between said first end and said polarity terminal while said second end of said coil spring remains secure at the portion of said casing nearer its open end thereby providing an electrical path from said polarity terminal near the closed end of said casing to an area near the opening end of said casing where it is adapted to electrically contact said switch means or a terminal of said lamp.

2. The flashlight of claim 1 wherein said battery casing has internal longitudinal ribs designed such that the end of the ribs closer to the open end of the battery casing defines said cross-sectional area that has an internal inscribed circular diameter smaller than the external inscribed circular diameter at the second end of said coil spring.

3. The flashlight of claim 1 wherein a radially directed internal flange is disposed near the open end of said battery casing such that said internal flange defines said cross-sectional area that has an internal inscribed circular diameter smaller than the external inscribed circular diameter of the second end of said coil spring.

4. The flashlight of claim 1 wherein said second end of said coil spring is coiled to form a circular configuration that defines said external inscribed circular diameter at said second end.

5. The flashlight of claim 1 wherein said coil spring comprises a lower portion defining an internal first cavity sufficient to accommodate battery means, an upper portion defining an internal second cavity larger than said first cavity, and said first cavity and said second cavity being in axial alignment.

6. The flashlight of claim 1 wherein said switch means is assembled in a switch module having a front threaded segment at one end and a second threaded segment at the opposite end, said casing wherein the open end has a threaded segment, said lens and reflector unit having a threaded segment at one end, and wherein said switch module has its first threaded segment secured on the threaded segment of the lens and reflector unit and its second threaded segment secured on the threaded segment of the battery casing.

7. The flashlight of claim 6 wherein a gasket is added between each of the mating threaded sections of the flashlight.

8. The flashlight of claim 2 wherein said second end of said coil spring is coiled to form a circular configuration that defines said external inscribed circular diameter at said second end.

9. The flashlight of claim 3 wherein said second end of said coil spring is coiled to form a circular configuration that defines said external inscribed circular diameter at said second end.

10. The flashlight of claim 2 wherein said coil spring comprises a lower portion defining an internal first cavity sufficient to accommodate battery means, an upper portion defining an internal second cavity larger than said first cavity, and said first cavity and said second cavity being in axial alignment.

11. The flashlight of claim 3 wherein said coil spring comprises a lower portion defining an internal first cavity sufficient to accommodate battery means, an upper portion defining an internal second cavity larger than said first cavity, and said first cavity and said second cavity being in axial alignment.

* * * * *